US006737150B2

(12) United States Patent
Zahler et al.

(10) Patent No.: US 6,737,150 B2
(45) Date of Patent: May 18, 2004

(54) FOLDING FLOOR MAT

(75) Inventors: Todd T. Zahler, Columbus, OH (US); James W. Critcher, Columbus, OH (US)

(73) Assignee: Everwear Professional Products, Inc., Columbus, OH (US)

( * ) Notice: Subject to any disclaimer, the term of this patent is extended or adjusted under 35 U.S.C. 154(b) by 0 days.

(21) Appl. No.: 09/966,346

(22) Filed: Sep. 28, 2001

(65) Prior Publication Data

US 2003/0232175 A1 Dec. 18, 2003

(51) Int. Cl.[7] ..... B32B 3/00; A47G 9/06
(52) U.S. Cl. ..... 428/156; 428/213; 5/417
(58) Field of Search ..... 5/417; 15/215; 296/97.23; 428/121, 130, 156, 188, 213

(56) References Cited

U.S. PATENT DOCUMENTS

| | | | | |
|---|---|---|---|---|
| 3,802,144 A | | 4/1974 | Spica | |
| 3,846,945 A | | 11/1974 | Roby | |
| 4,109,439 A | | 8/1978 | Feasel | |
| 4,167,599 A | | 9/1979 | Nissinen | |
| 4,468,910 A | | 9/1984 | Morrison | |
| 4,476,174 A | | 10/1984 | Carrera | |
| 4,478,901 A | | 10/1984 | Dickens et al. | |
| 4,584,221 A | | 4/1986 | Kung | |
| 4,596,729 A | | 6/1986 | Morrison | |
| 4,784,888 A | * | 11/1988 | Schwertner et al. | 428/67 |
| 4,940,620 A | | 7/1990 | Silk et al. | |
| 5,073,428 A | * | 12/1991 | Lancelot et al. | 428/67 |
| 5,173,346 A | | 12/1992 | Middleton | |
| 5,275,502 A | | 1/1994 | Glaza et al. | |
| 5,815,995 A | | 10/1998 | Adam | |
| 6,183,833 B1 | * | 2/2001 | Robbins et al. | 428/80 |
| 6,258,202 B1 | | 7/2001 | Callas | |

* cited by examiner

*Primary Examiner*—Donald J. Loney
(74) *Attorney, Agent, or Firm*—M. Reid Russell

(57) ABSTRACT

A folding floor mat that is formed from a plurality of panels formed from a resilient polymeric material and having a work surface and a grip surface. Flexible hinge assemblies foldably join at least two of the panels along a fold boundary, which preferably incorporates a plurality of channels that are integrally formed in the work and grip surfaces. More preferably, the channels are laterally spaced apart about the grip and or work sides. Even more preferably, the channel or channels formed in the work surface are staggered relative to the channel or channels formed in the grip surface. Also, each channel is ideally shaped to optimize relief internal material stresses of the polymeric material during and after it has been folded. The folding mat is manufactured from any of a number of readily available thermoplastic and similarly capable materials that are resilient, flexible, and durable and resistant to abrasion wear and impervious to biological, food service, health care, and industrial fluids and substances including steam, high temperature water, cleaning fluids, petrochemicals, animal fats, biological fluids, cooking oils and greases, and raw and prepared agricultural food stuffs. In the most preferably configuration, the folding mat is sized to be folded to have a maximum folded dimension compatible for cleaning in, for example without limitation, food service and medical industry standard cleaning units such as dish washers and sterilization units.

20 Claims, 4 Drawing Sheets

FOLDING FLOOR MAT

TECHNICAL FIELD

This invention relates to a reusable and conveniently cleanable and transportable fatigue reducing foldable floor mat that is well-suited for use in a wide variety of industrial, healthcare, food service, and similar applications.

BACKGROUND OF THE INVENTION

In the various pertinent industries, including for purposes of illustration but not limitation, food service and medical professional applications, those with skill in the art have long-recognized the need for various fatigue reducing devices, such as cushioned floor mats. In the noted examples of the food and medical industries, chefs and surgeons alike have suffered from seriously debilitating maladies of the back and legs resulting from their long hours spent standing. Many prior art attempts have been made to minimize such fatigue for purposes of mitigating the painful consequences of standing for long periods of time.

For example, attempts have been made to create floor mats adapted to facilitate fluid drainage, as in U.S. Pat. No. 3,802,144 to Spica, while others were more directed towards developing well-padded surfaces as in U.S. Pat. No. 3,846,945 to Roby, which among other features, purports to offer a fatigue relief capability. Devices such as the Roby floor mat have also sought to teach multi-paneled mat arrangements having panel-to-panel interconnection capabilities. Additional multi-panel configurations are illustrated, along with other various features, in U.S. Pat. Nos. 4,167,599 to Nissinen, 4,468,910 to Morrison, and U.S. Pat. No. 5,275,502 to Glaza et al. Yet other prior floor mats have attempted to improve the field of art by focusing on improved traction, in addition to previous features, such as in U.S. Pat. No. 4,596,729 to Morrison, and U.S. Pat. No. 5,815,995 to Adam. And, still others aimed to improve the liquid and debris collection capability of foldable floor mats. See, for example, U.S. Pat. No. 4,940,620 to Silk et al. for a food collection mat for high-chairs and U.S. Pat. No. 5,173,346 to Middleton for a sponge floor mat for surgical applications.

What continues to be missing from the technical field of floor mats is a solution to the need for ease of introduction to the work place or station, easy cleaning after work is completed, and convenience of storage and transport after cleaning. While many of the prior art devices aimed to improve these attributes in the art of such mats, none has achieved an optimized capability in an easy to fabricate, convenient to use form that is readily suited to application in the myriad industries that have demonstrated a need for portable, easy-to-clean, and convenient to transport and stow floor mats.

What has been needed but heretofor unavailable in the prior art devices and methods, is a floor mat that is adapted to low-cost, high volume manufacturing techniques and processes. Also, what continues to be needed is a foldable, fatigue-reducing, and traction improving floor mat that is easily deployed for use, and that is compatible for cleaning with widely available and well-entrenched industry cleaning equipment, including commercial and food service dish washers and medical poison gas and steam heat autoclaves. Moreover, such a preferred floor mat must also offer convenient transport and stowage that improves upon the currently available rolled and folded mats, while still maintaining the preceding preferred and long-sought capabilities.

The most preferable folding floor mat would be compatible for use in wide-ranging industrial applications involving standing for long periods of time, as well as professional industries such as food preparation services and surgical applications, among many other situations that require long duration standing activities.

The present invention meets these and other needs without adding any complexity, inefficiencies, or significant costs to implementation in existing applications and environments. In fact, the preferred folding floor mat according to the present invention can be implemented with relatively low-cost modifications to existing floor mat fabrication equipment and methods. The various embodiments of the present invention disclosed are readily adapted for ease of manufacture, low fabrication costs, and immediate compatibility with both the most widely available and installed manufacturing and cleaning equipment used in the previously described industries, as well as similar equipment that may subsequently become available.

SUMMARY OF INVENTION

In its most general capacity, the present invention injects a variety of new capabilities into the field and overcomes many of the shortcomings of the prior art in a variety of ways. In one of the many preferable configurations, the folding floor mat according to the present invention includes, among other elements, a plurality of panels, for example, 2, 3, 4, or more panels that are preferably formed from a resilient polymeric material such as a thermoplastic. The more favored floor mat of the instant invention incorporates panels that are substantially planar and formed to have a work surface that is configured to support a worker and a grip surface that includes features for optimized application to a flooring surface.

Additionally, the present invention contemplates the floor mat having a flexible hinge assembly adapted to foldably join together the panels along a respective fold boundary disposed between adjacent panels. More preferably, the hinge assemblies are formed from or incorporate at least two channels that are integrally formed in the work and grip surfaces proximate to the fold boundary. The channels are generally spaced apart from one another and are shaped to have a profile that is selected for the capability to relieve internal stresses in the polymeric material when the panels are folded together.

In variations of the preceding configurations, the polymeric material of the folding floor mat is selected to be a resilient, flexible, and durable material that resists abrasion wear and that can withstand exposure to severe and deleterious fluids and substances, such as, without limitation, biological, food service, health care, and industrial fluids and substances. Some such exemplary substances and fluids include steam, high temperature water, cleaning fluids, petrochemicals, animal fats, biological fluids, cooking oils and greases, bacteria, fungi, insects, pests, and raw and prepared agricultural food stuffs, to name a few.

More specifically, any of the preceding embodiments may include panels and hinge assemblies preferably formed from polymeric material that is selected from the group including thermoplastics, thermoformed plastics, thermoset plastics, elastomers, grease-resistant rubbers, vinyls, polyvinyl chlorides, acetal resins, delrin, fluorocarbons, polyesters, polyester elastomers, metallocenes, polyamides, nylon, polybutadienes, silicone resins, ABS (acrylonitrile, butadiene, styrene), polypropylenes, liquid crystal polymers, and combinations, composites, mixtures, admixtures, alloys, laminates, reinforced compositions, and hybrids thereof.

In alternative configurations of one or more of the previously described embodiments, the hinge assemblies are formed to have a minimum cross-sectional thickness to optimize durability while facilitating foldability. This capability is achieved from configurations wherein the polymeric material proximate to the fold boundary is formed with a minimum cross-sectional thickness of between about 10% and about 70% or so of the maximum total thickness of the mat between the work and grip surfaces. Even more preferably, any of the preceding configurations are formed whereby the polymeric material has a minimum cross sectional boundary thickness of between approximately 30% and approximately 60% of such maximum mat thickness.

In yet other alternatives and modifications to the previously illustrated exemplary configurations, the folding floor mat of the instant invention incorporates hinge assemblies formed from, among other features, channels that are formed with a cross sectional profile that improves the stress relieving function of the hinge assembly. It has been found that certain types of such profiles are effective for this purpose and include, for purposes of illustration but not limitation, curvilinear such as concave and convex, rectilinear, rectangular, and trapezial profiles.

The preferred floor mat hinge assemblies have also been further modified in other alternatives of the various preceding embodiments with enhanced durability and ability to fold capabilities by arranging the channels that are formed in the work surface to be generally offset or staggered relative to the channels that are formed in the underlying grip surface.

Further optional variations of the preceding modifications also include work and grip surfaces that are also formed to have stipple and or dimple patterns of raised portions. More preferably, the raised portions formed on the grip surface are arranged to project generally downwardly and are adapted to establish fluid passageways by raising areas of the grip surface above an underlying floor surface. Similarly, such projections are further adapted to improve traction against the floor surface to maximize the anti-skid capability of the mat as it lies on the floor during use. In an analogous manner, the raised portions of the work surface are adapted as traction ridges that project generally upwardly to improve the anti-skid capability of the mat as it performs in use by a worker.

In another preferred variation of the preceding embodiments, the folding floor mat according to the instant invention incorporates four quarter panels arranged generally in the shape of a rectangle. As with preceding configurations, the panels are similarly formed from a resilient polymeric material and to have work and grip surfaces. The panels also include flexible hinge assemblies that are integrally formed in the polymeric material of the panels and hinges are adapted to foldably join the quarter panels along at least three fold boundaries. Also, at least two of the four panels preferably define an interstice therebetween to further facilitate foldability, among other benefits. In further optional modifications of the preceding embodiments, this configuration can also be adapted to incorporate hinge assemblies formed with channels formed in the work and grip surfaces about the fold boundaries and spaced apart and staggered as described earlier. Even more preferably, the offset or staggered channels are formed as two or more stress relief notches formed in the boundary of the work surface, and three or more stress relief notches formed in the grip surface boundaries.

These variations, modifications, and alterations of the various preferred embodiments may be used either alone or in combination with one another as can be better understood by those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures, wherein like reference numerals and numerals with primes across the several drawings, figures, and views refer to identical, corresponding, and or equivalent elements, features, components, and parts:

Also, in the various figures and drawings, an orientation frame of reference designated generally by reference letter "R", and having directions denoted generally by reference letters X, Y, and Z, is depicted to better describe the various rotations and arrangements of elements described across the figures and illustrations of drawing sheets.

DESCRIPTION OF THE PREFERRED EMBODIMENT

The folding mat according to the present invention demonstrates an important step forward in the field of industrial, food service, and health care floor mats. Many ineffective and unsuccessful attempts have been made to create a fatigue reducing floor mat having the convenience and efficiency of the present invention. The preferred folding floor mat practiced with the principles of the instant invention has wide application for food service, health care, and to industrial professionals, who have long sought a resilient, flexible, easy-to-clean, and easily transportable mat that can be introduced into the work environment, and quickly removed, cleaned, stored, and or transported at the conclusion of the work period with minimal effort and inconvenience. The preferred configurations and described alternatives, modifications, and variations of the folding floor mat of the instant invention overcomes prior shortcomings and accomplishes new and novel solutions to the prior art problems with new and novel configurations and arrangements of inventive elements that are uniquely configured in novel ways, which demonstrate previously unavailable capabilities.

With reference now to the accompanying figures and specifically to FIGS. 1 through 8, folding floor mat 100 is shown, which is configured in a fatigue reducing, traction improving, and foldable layout that is adapted for ease of deployment, cleaning, stowage, and transport. As represented in the various figures, the floor mat 100 is not necessary shown to scale but is shown in one of many possible and equally desirable representative relative dimensional proportions, as will be apparent to those with skill in the art. For example, although the floor mat 100 is shown to have a generally rectangular configuration, any of a wide variety of equally suitable 3-dimensional envelopes and profiles are available and would be compatible for purposes of and contemplated by the floor mat of the present invention.

Figure 1:
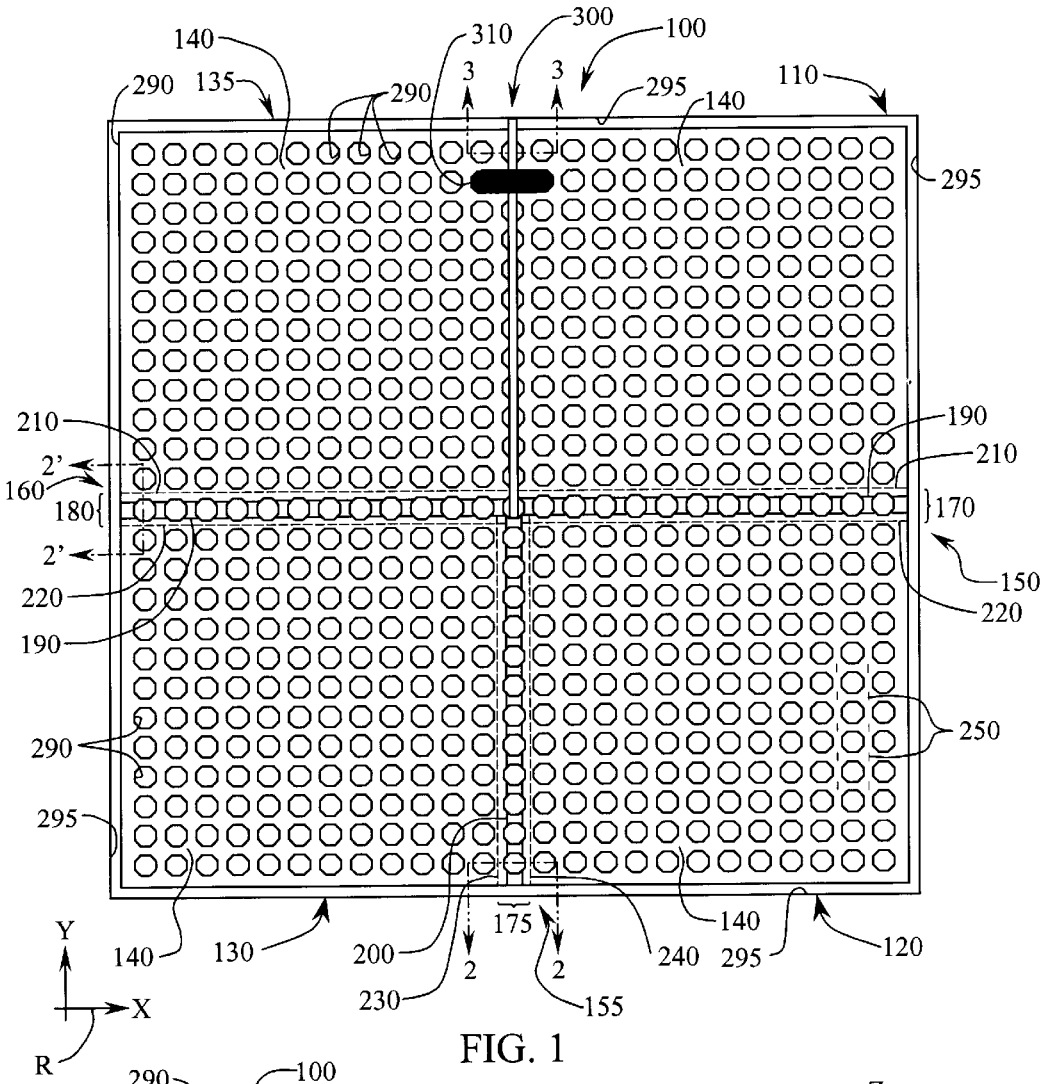
FIG. 1 is a top or plan view, in reduced scale, of a folding mat according to the present invention and configured as food and beverage service folding mat.

With specific reference also now to FIG. 1, the folding floor mat 100 according to the present invention preferably includes, among other features and components, a plurality of panels, such as for illustration purposes without limitation, panels. The panels are preferably formed from a generally planar resilient, flexible, and durable polymeric material that can withstand heavy-duty abrasion and use and that resists wear and tear due to repeated and continuous exposure to deleterious cleaning and environmentally present fluids and substances. Such fluids and substances can include biological, food service, health care, and industrial fluids and substances of varying temperatures and compositions.

An even more specific example of such offensive substances and fluids includes cleaning fluids such as steam and high temperature water and other cleaning fluids that can have an alkaline or acidic relative pH, as well as petrochemicals, animal fats, biological fluids and medicinal fluids encountered in health care applications, cooking oils and greases, bacteria, fungi, insects, pests, and other food particles and fluids that may fall upon the floor mat 100 during use in food service and preparation environments.

For purposes of ensuring resistance to and compatibility for use with any of the preceding environments and fluids and substances, the polymeric material of the panels 110, 120, 130, 135 may selected from a large variety of materials that can be selected to accommodate the desired environmental considerations as well as fabrication and cost issues. Such materials that are suitable for purposes of the instant invention include, for example but not limitation, thermoplastics, thermoformed plastics, thermoset plastics, elastomers, grease-resistant rubbers, vinyls, polyvinyl chlorides, acetal resins, delrin, fluorocarbons, polyesters, polyester elastomers, metallocenes, polyamides, nylon, polybutadienes, silicone resins, ABS (acrylonitrile, butadiene, styrene), polypropylenes, liquid crystal polymers, and combinations, composites, mixtures, admixtures, alloys, laminates, reinforced compositions, and hybrids thereof. Additionally, for even greater resistance and improved performance that polymeric material selected can be further treated with a wide variety of bacteriocides, fungicides, and pesticides that can be incorporated into or onto the formed panels 110, 120, 130, 135. One of many possible suitable floor-type mats that can be significantly modified to have the capabilities according to the principles of the instant invention, which would then be for use as contemplated herein is described, in certain limited respects, in U.S. Pat. No. 4,478,901 to Dickens et al., which is incorporated by reference herein in its entirety.

Preferably, the panels 110, 120, 130, 135 described herein are formed to be substantially planar and are formed with a generally upwardly facing work surface 145, which is adapted for compatibility with shoes and other foot gear that is commonly in use the relevant industries. The majority of the previously described polymeric materials have been found to be especially suitable therefor. Also, the panels 110, 120, 130, 135 are formed with a generally downwardly facing grip surface 145 that may optionally include elements and features, described in more detail hereinbelow, that are directed towards improving the traction and anti-skid capability of the floor mat 100 when placed upon floor surfaces (not shown) during use.

The floor mat 100 practiced according to the present invention further incorporates a flexible hinge assemblies 150, 155, 160. The hinge assemblies are configured to foldably join together the panels 110, 120, 130, 135 along a respective fold boundary 170, 175, 180 disposed between adjacent panels 110, 120, 130, 135.

The hinge assemblies 150, 155, 160 are formed from or incorporate, among other elements, channels 190, 200, 210, 220, 230, 240 that are integrally formed in the work and grip surfaces proximate to the respective fold boundary 170, 175, 180. The channels 190, 200, 210, 220, 230, 240 are generally spaced apart from one another and are shaped to have a profile that is selected for the capability to relieve internal stresses in the polymeric material when the panels are folded together.

Figure 2A:
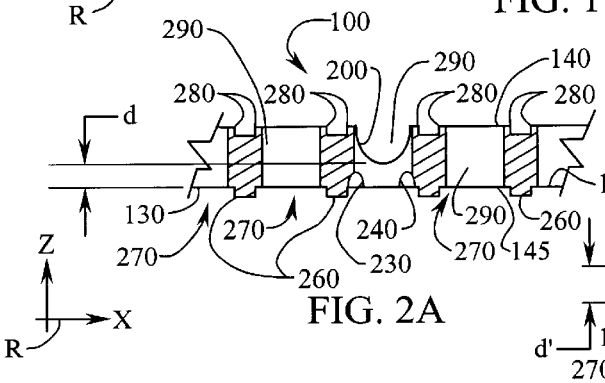
FIG. 2A is a rotated section view, in enlarged scale, taken along section line 2—2 of FIG. 1, and is similar or analogous to a cross section (not shown) taken along section line 2'—2' of FIG. 1.
Figure 2B:
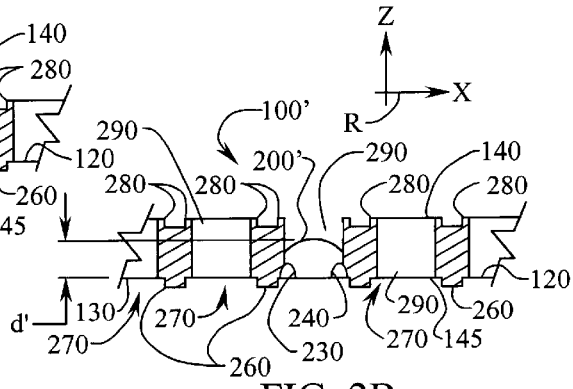
FIG. 2B is a rotated section view, in enlarged scale, taken along section line 2—2 of FIG. 1 of an alternative modification of the configuration depicted in FIG. 2A.
Figure 3:
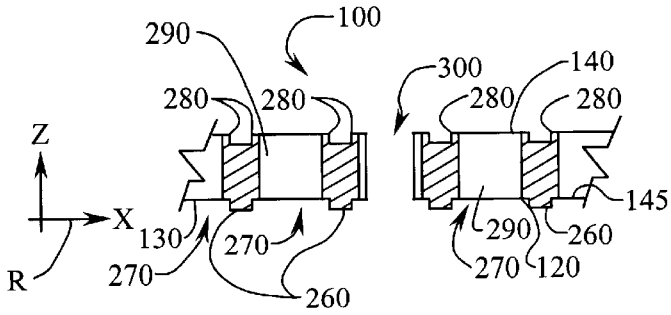
FIG. 3 is a rotated section view, in enlarged scale, taken along section line 3—3 of FIG. 1.
Figure 4:
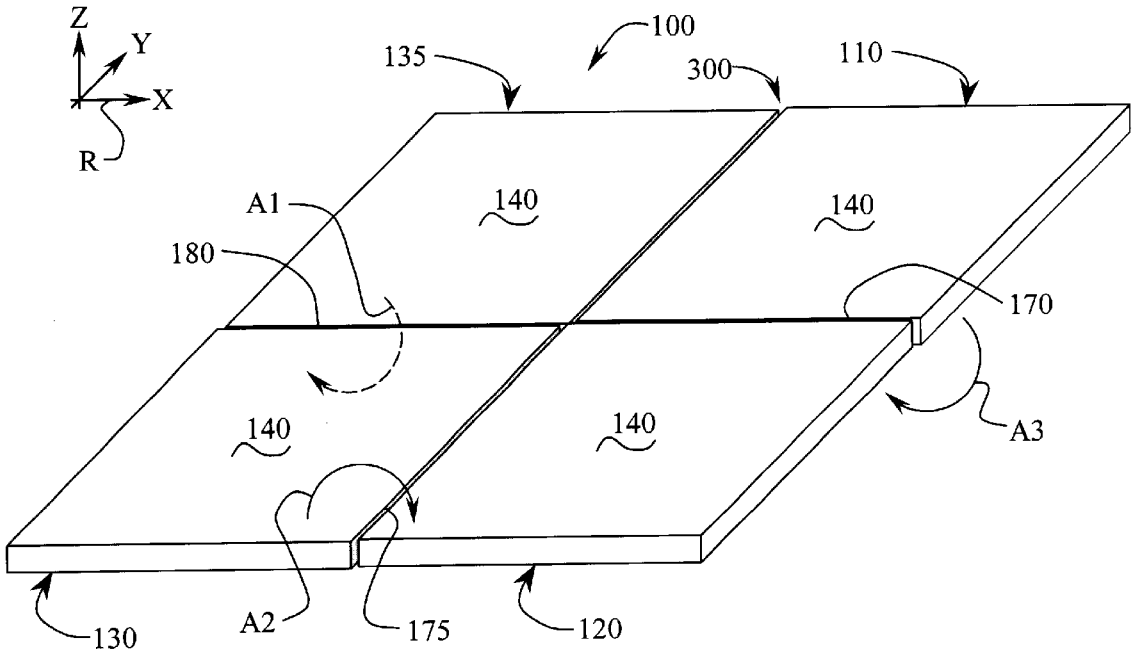
FIG. 4 is an elevated perspective schematic view of the folding mat of FIG. 1.
Figure 5:
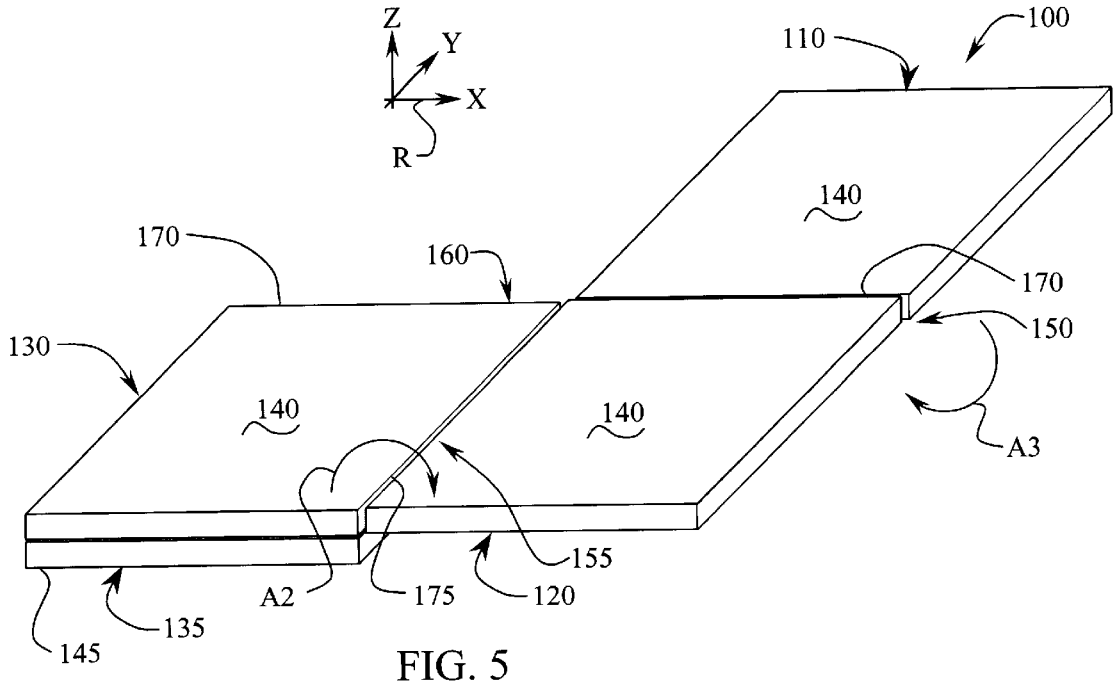
FIGS. 5 through 7 are elevated perspective schematic views of the folding mat of FIG. 4, reflecting various portions of the mat in a folded configuration.
Figure 6:
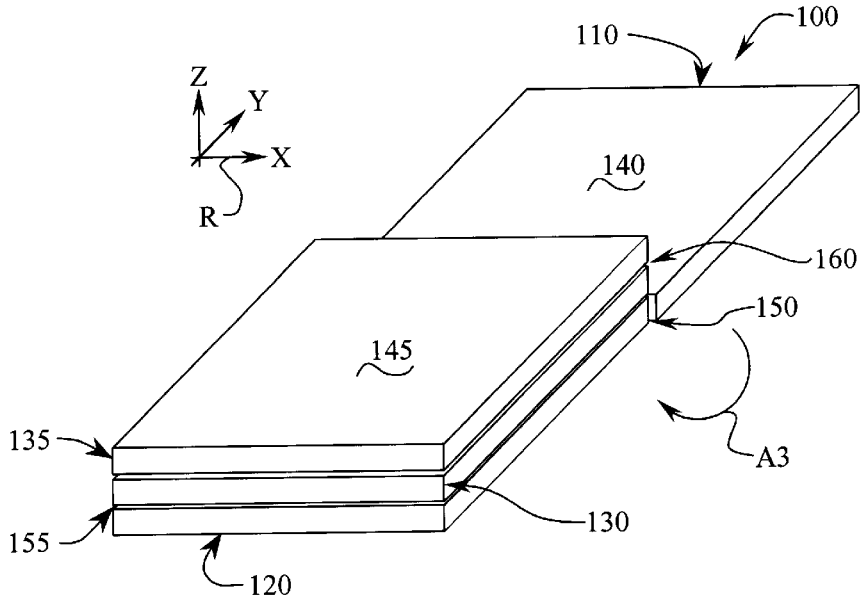
Figure 7:
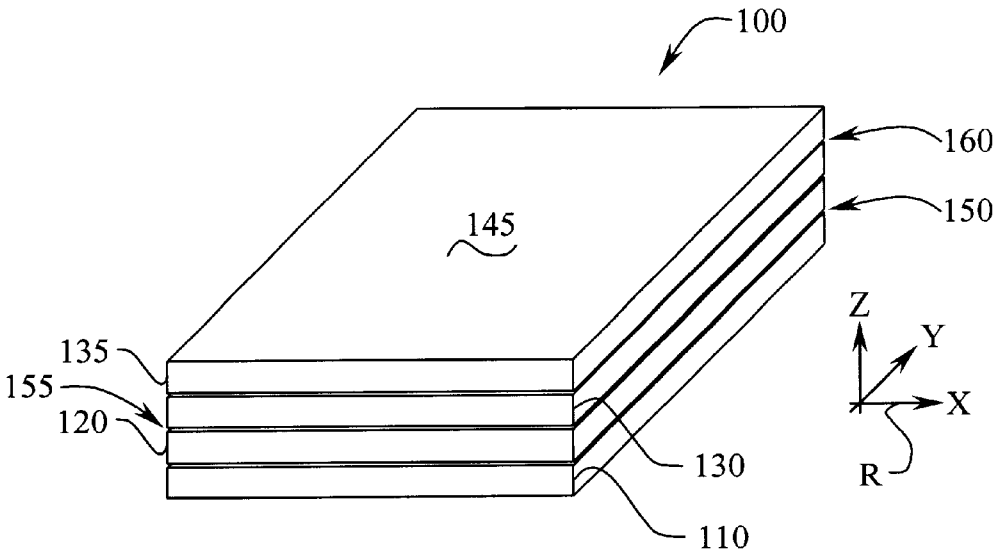

With reference now also specifically to FIGS. 2A and 2B, those with skill in the art can further appreciate that any of the previously described embodiments and variations of the hinge assemblies 150, 155, 160 can be fabricated with a minimum cross-sectional thickness, such as that depicted by the relative dimension labeled by reference letters "d " and " d'". An alternative floor mat 100' is reflected in FIG. 2B and is constructed similarly to that of floor mat 100 illustrated in FIGS. 1, 2A, and other drawings. It has been demonstrated in practice that ensuring such a minimum thickness can greatly improve durability while facilitating foldability of the panels 110, 120, 130, 135 of the floor mat 100.

Even more preferably, the improved foldability and durability is obtained wherein the polymeric material of the hinge assemblies 150, 155, 160 in the region of the respective fold boundaries 170, 175, 180 is formed to have a minimum cross-sectional thickness d and d' of between approximately 10% and approximately 70%, or so of the maximum total thickness of the mat 100 between the exterior-most projection of the work and grip surfaces 140, 145. Also, more preferably, any of the preceding embodiments and alternatives are formed to have a minimum cross sectional boundary thicknesses d and d' of approximately between 30% and 60% of the maximum mat thickness.

With continued reference to FIGS. 2A and 2B, other demonstrative alternatives and modifications of the contemplated embodiments of the folding floor mat 100, 100' of the present invention includes hinge assemblies 150, 155, 160 that are formed from or that incorporate, among other possible features, the channels 190, 200, 210, 220, 230, 240, which are configured to have respective cross sectional profiles directed to improve the stress relieving function of the corresponding hinge assembly 150, 155, 160.

In practice, demonstrated embodiments and alternatives and modifications thereto have proven that many types of profiles are effective. For example, in FIG. 2A, a convex cross sectional curvilinear profile is illustrated that is incorporated in channel 200. In contrast for further illustration, FIG. 2B depicts a channel 200' that forms a convex curvilinear cross sectional profile. Yet other cross sectional profiles have also been demonstrated to provide the desired internal stress relief for the polymeric material, and include curvilinear, rectilinear, rectangular, and trapezial profiles, some of which are shown and described below as additional exemplary modification to the exemplary embodiments.

Figure 8:
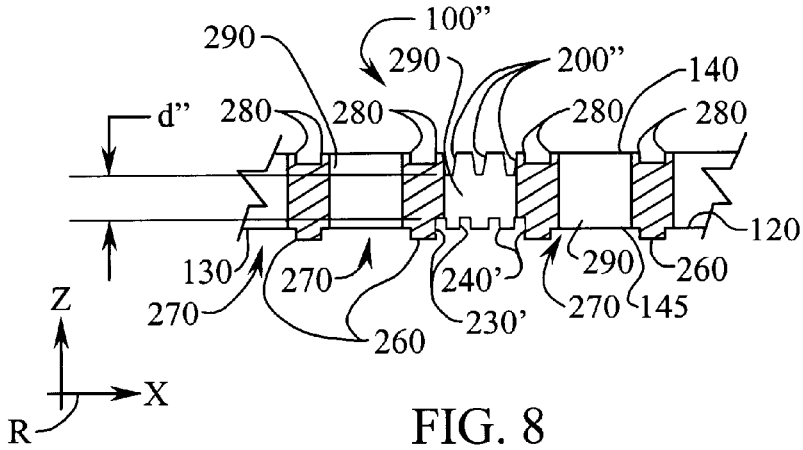
FIG. 8 is a rotated section view, in enlarged scale, taken along either section line 2—2 or 2'—2' of FIG. 1, and showing another alternative configuration of the folding panel of FIG. 1.

The preferred floor mat hinge assemblies 150, 155, 160 may also optionally incorporate modifications directed to further improving the durability and foldability of the instant invention wherein the channels 190 and 200 that are formed in the work surface 140 are arranged to be staggered or offset from those channels 210, 220, 230, 240 that are formed in the grip surface 145. In more detail for purposes of further illustration, and with specific reference to FIGS. 2A and 2B, it can be understood that the channels 200, 200' of the work surface 140 are staggered relative to channels 230, 240 in the direction denoted generally by reference letter X of frame of reference R. With reference also now to FIG. 8, an alternative floor mat 100" is shown, which is contemplated and compatible for use in any of the preceding modifications and variations. The mat 100" is formed with a minimum thickness d" and incorporates a plurality of channels 200" that are formed in the work surface 140 and a plurality of channels 230' and 240' included in the grip surface 145. The modified alternative channel arrangement also includes the relative staggering relationship described earlier. The alternative channels 200", 230', 240' are also further modified to illustrate yet other alternative cross sectional profiles.

Any of the preceding configurations and variations of exemplary embodiments may also include work and grip surfaces 140, 145 that include patterns of anti-skid or traction improving raised portions, such as projections 250 (FIG. 1) that may take the form of stipple and or dimple patterns that may be formed about portions of or across the entire surfaces of work and grip surfaces 140, 145.

More preferably, some of such raised portions are formed as portions 260 (FIGS. 2A, 2B, 8) on the grip surface 145 and are arranged to project generally downwardly and are adapted to establish fluid passageways 270 by raising areas of the grip surface 145 above an underlying floor surface (not shown). Similarly, such projections 260 are further adapted to improve traction against the floor surface to maximize the anti-skid capability of the mat 100, 100', 100" as it lies on the floor during use. Similarly, alternative configurations of raised portions of the work surface 140 are adapted as traction ridges 280 that project generally upwardly to improve the anti-skid capability of the mat 100, 100', 100" as it is used by a worker (not shown).

In yet additional variations and modifications of any of the preceding embodiments, the mat 100, 100', 100" may also be further formed with patterns of recesses 290 adapted to capture fluids and substances (not shown) cast off by users during operation. Additionally, an optional inclined ramp portion 295 (FIG. 1) may also be formed about the periphery of the panels 110, 120, 130, 135 and or the unfolded floor mat 100, 100', 100" to further improve the capability of the mat 100, 100', 100" to lower the profile of the outermost edges for added convenience. Further variations and embodiments of the folding floor mat 100, 100', 100" include hinge to assemblies 150, 155, 160 that are formed without the patterns of recesses 290 (FIGS. 1, 2A, 2B, 2, and 8) being formed in the fold boundaries 170, 175, 180 for added durability.

In another preferred variation of the preceding embodiments, the folding floor mat 100, 100', 100" according to the instant invention is configured wherein at least two of the plurality of panels 110, 120, 130, 135 (FIG. 1), such as panels 110, 135 are preferably arranged to define an interstice 300 therebetween (FIGS. 1 and 3) to further facilitate foldability of the folding floor mat 100, 100', 100". Other preferred alternatives may also employ a connector 310 that is adapted, for example to secure the unfolded mat 100, 100', 100" about the interstice 300. Variations of the connector 310 also may be adapted to engage one or more of the recesses 290 to, for example, secure the panels 110 and 135 about the interstice 300.

In another exemplary modification that is compatible with any of the preceding embodiments, variations, and alternatives, the folding floor mat 100, 100', 100" is adapted to have a generally rectangular exterior profile as depicted in FIG. 1 that is preferably approximately 36 inches square in the unfolding configuration. Additionally, the panels 110, 120, 130, 135 are further configured to also be generally rectangular in their exterior profile and even more preferably are adapted to have a generally square profile of about 18 inches as can be understood with continued reference to FIG. 1. In this alternative arrangement, the floor mat 100, 100', 100" can be folded to have a generally cuboid 3-dimensional profile shape that has an outer profile measuring approximately 18 inches square in 2 of the 3 dimensions of the cuboid, which is compatible for use in most commercial and food service dish washing equipment. Additional sizes, shapes, and dimensions are easily imparted to the floor mat 100, 100', 100" practiced according to the present invention for compatibility with a wide variety of other types of industry cleaning and sterilization equipment, including, for example, pressurized steam heat cleaning and sterilization devices and autoclaves, and gas cleaning and sterilization equipment such as ethylene oxide, ethylene dioxide, or hydrogen peroxide gas systems.

With continued reference to the preceding figures and specific now also to schematic illustrations of the folding operation depicted by FIGS. 4 through 7, those with skill in the art can understand that the folding floor mat 100, 100', 100" according to the invention is foldable about fold boundaries 170, 175 in the fold directions indicated by the motion arrows designated generally by reference letters A1, A2, A3.

Numerous alterations, modifications, and variations of the preferred embodiments, configurations, modifications, variations, and alternatives disclosed herein will be apparent to those skilled in the art and they are all contemplated to be within the spirit and scope of the instant invention. For example, although specific embodiments have been described in detail, those with skill in the art can understand that the preceding embodiments and variations can be further modified to incorporate various types of substitute and/or additional polymeric materials, panel quantities, shapes, thicknesses, relative arrangement of elements, and dimensional and proportional configurations for compatibility with the wide variety of industrial, commercial, and professional services environments known to and available in the respective industries. Accordingly, even though only few variations of the present invention are described herein, it is to be understood that the practice of such additional modifications and variations and the equivalents thereof, are within the spirit and scope of the invention as defined in the following claims.

We claim:

1. A folding floor mat, comprising:

a plurality of panels formed from a resilient polymeric material and having a work surface and a grip surface;

flexible hinge assemblies foldably joining at least two of the panels along fold boundaries; and the hinge assemblies being formed from a plurality of channels integrally formed in the work and grip surfaces proximate to the boundaries, the channels being spaced apart and shaped to relieve internal stresses in the polymeric material upon folding.

2. The folding floor mat according to claim 1, wherein the polymeric material is formed from a resilient, flexible, and durable material that resists abrasion wear and that is impervious to biological, food service, health care, and industrial fluids and substances including steam, high temperature water, cleaning fluids, petrochemicals, animal fats, biological fluids, cooking oils and greases, and raw and prepared agricultural food stuffs.

3. The folding floor mat according claim 2, wherein the polymeric material is selected from the group including thermoplastics, thermoformed plastics, thermoset plastics, elastomers, grease-resistant rubbers, vinyls, polyvinyl chlorides, acetal resins, delrin, fluorocarbons, polyesters, polyester elastomers, metallocenes, polyamides, nylon, polybutadienes, silicone resins, ABS (acrylonitrile, butadiene, styrene), polypropylenes, liquid crystal polymers, and combinations, composites, mixtures, admixtures, alloys, laminates, reinforced compositions, and hybrids thereof.

4. The folding floor mat according claim 1, wherein the polymeric material has a minimum thickness about a cross section proximate to the boundaries of between approximately 10% and approximately 70% of the maximum thickness of the mat between the work and grip surfaces.

5. The folding floor mat according claim 1, wherein the polymeric material has a minimum cross sectional thickness proximate to the boundaries of between approximately 30% and approximately 60% of the maximum thickness of the mat between the work and grip surfaces.

6. The folding floor mat according claim 1, wherein at least one of the plurality of channels is formed to have a cross sectional profile that is selected from the group of profiles including concave, convex, rectilinear, rectangular, and trapezial.

7. The folding floor mat according claim 1, wherein at least two of the channels of the plurality are arranged about the hinge assembly in an offset relationship.

8. The folding floor mat according claim 1, wherein the work and grip surfaces are further formed with raised portions; and wherein the raised portions formed on the grip surface project generally downwardly and are configured to establish fluid passageways and wherein the raised portions of the work surface form generally upwardly projecting traction ridges.

9. A folding floor mat, comprising:

a plurality of panels formed from a resilient polymeric material and having a work surface and a grip surface;

flexible hinge assemblies integrally formed in the polymeric material and foldably joining at least two of the panels along fold boundaries;

the hinge assemblies being formed from a plurality of channels integrally formed in the work and grip surfaces proximate to the boundaries, the channels being spaced apart and shaped to relieve internal stresses in the polymeric material upon folding; and the plurality of channels being arranged about the work and grip surfaces in a staggered relationship.

10. The folding floor mat according to claim 9, wherein the polymeric material is formed from a resilient, flexible, and durable material that resists abrasion wear and that is impervious to biological, food service, health care, and industrial fluids and substances including steam, high temperature water, cleaning fluids, petrochemicals, animal fats, biological fluids, cooking oils and greases, and raw and prepared agricultural food stuffs.

11. The folding floor mat according claim 10, wherein the polymeric material is selected from the group including thermoplastics, thermoformed plastics, thermoset plastics, elastomers, grease-resistant rubbers, vinyls, polyvinyl chlorides, acetal resins, delrin, fluorocarbons, polyesters, polyester elastomers, metallocenes, polyamides, nylon, polybutadienes, silicone resins, ABS (acrylonitrile, butadiene, styrene), polypropylenes, liquid crystal polymers, and combinations, composites, mixtures, admixtures, alloys, laminates, reinforced compositions, and hybrids thereof.

12. The folding floor mat according claim 9, wherein the polymeric material has a minimum thickness about a cross section proximate to the boundaries of between approximately 10% and approximately 70% of the maximum thickness of the mat between the work and grip surfaces.

13. The folding floor mat according claim 9, wherein the polymeric material has a minimum cross sectional thickness proximate to the boundaries of between approximately 30% and approximately 60% of the maximum thickness of the mat between the work and grip surfaces.

14. The folding floor mat according claim 9, wherein at least one of the plurality of channels is formed to have a cross sectional profile that is selected from the group of profiles including concave, convex, rectilinear, rectangular, and trapezial.

15. The folding floor mat according claim 9, wherein the work and grip surfaces are further formed with raised portions; and wherein the raised portions formed on the grip surface project generally downwardly and are configured to establish fluid passageways and wherein the raised portions of the work surface form generally upwardly projecting traction ridges.

16. A folding floor mat, comprising:

four quarter panels formed from a resilient polymeric material and having a work surface and a grip surface;

flexible hinge assemblies integrally formed in the polymeric material and foldably joining the quarter panels along at least two fold boundaries and wherein at least two of the four panels define an interstice therebetween;

the hinge assemblies being formed from a plurality of channels integrally formed in the work and grip surfaces proximate to the fold boundaries, the channels being spaced apart and shaped to relieve internal stresses in the polymeric material upon folding;

the plurality of channels including at least two stress relief notches being formed about the work surface boundaries and the channel plurality further including at least three stress relief notches being formed about the grip surface boundaries in an offset relationship relative to the work surface notches; and wherein the polymeric material has a minimum cross sectional thickness proximate to the boundaries of between approximately 30% and approximately 60% of the maximum thickness of the mat between the work and grip surfaces.

17. The folding floor mat according to claim 16, wherein the polymeric material is formed from a resilient, flexible, and durable material that resists abrasion wear and that is impervious to biological, food service, health care, and industrial fluids and substances including steam, high temperature water, cleaning fluids, petrochemicals, animal fats, biological fluids, cooking oils and greases, and raw and prepared agricultural food stuffs.

18. The folding floor mat according claim 17, wherein the polymeric material is selected from the group including thermoplastics, thermoformed plastics, thermoset plastics, elastomers, grease-resistant rubbers, vinyls, polyvinyl chlorides, acetal resins, delrin, fluorocarbons, polyesters, polyester elastomers, metallocenes, polyamides, nylon, polybutadienes, silicone resins, ABS (acrylonitrile, butadiene, styrene), polypropylenes, liquid crystal polymers, and combinations, composites, mixtures, admixtures, alloys, laminates, reinforced compositions, and hybrids thereof.

19. The folding floor mat according claim 16, wherein the notches are formed to have a cross sectional profile that is selected from the group of profiles including concave, convex, rectilinear, rectangular, and trapezial.

20. The folding floor mat according claim 16, wherein the work and grip surfaces are further formed with raised portions; and wherein the raised portions formed on the grip surface project generally downwardly and are configured to establish fluid passageways and wherein the raised portions of the work surface form generally upwardly projecting traction ridges.

* * * * *